United States Patent [19]

Bennett

[11] Patent Number: 4,974,981

[45] Date of Patent: Dec. 4, 1990

[54] COSMETIC POWDER BRUSH WITH METERED POWDER DISPENSER

[75] Inventor: Robert A. Bennett, Easton, Conn.

[73] Assignee: Cosmetic Essence, Inc., Marlboro, N.J.

[21] Appl. No.: 307,616

[22] Filed: Feb. 7, 1989

Related U.S. Application Data

[63] Continuation-in-part of Ser. No. 144,555, Jan. 13, 1988, abandoned.

[51] Int. Cl.[5] ..... A46B 11/02

[52] U.S. Cl. ..... 401/123; 401/125; 401/126; 401/4; 401/184; 401/158; 401/162; 401/163; 401/161

[58] Field of Search ..... 401/158, 161, 160, 162, 401/123, 125, 183, 184, 185, 186, 4, 163, 164, 200, 168; 239/654; 132/294; 222/214

[56] References Cited

U.S. PATENT DOCUMENTS

| | | | |
|---|---|---|---|
| 854,226 | 5/1907 | Levy | 401/161 |
| 1,030,440 | 6/1912 | Waterman | 401/186 |
| 1,078,513 | 11/1913 | Parker | 401/158 |
| 1,172,293 | 2/1916 | Kohlhepp | 132/82 G |
| 1,247,169 | 11/1917 | Storer | 401/158 |
| 2,283,765 | 5/1942 | Rubin | 401/192 |
| 2,480,331 | 8/1949 | Lecker | 401/125 |
| 2,554,489 | 5/1951 | Crane | 401/183 X |
| 2,770,068 | 11/1956 | Jakab | 239/654 |
| 4,248,543 | 2/1981 | Carrington et al. | 401/183 |
| 4,626,119 | 12/1986 | Ladd, Jr. | 401/125 X |
| 4,630,955 | 12/1986 | Ladd, Jr. et al. | 401/125 X |
| 4,652,162 | 3/1987 | Ladd, Jr. et al. | 401/125 X |

FOREIGN PATENT DOCUMENTS

| | | | |
|---|---|---|---|
| 820193 | 9/1951 | Fed. Rep. of Germany | 401/125 |
| 691258 | 10/1930 | France | 401/161 |
| 991798 | 6/1951 | France | 401/184 |

*Primary Examiner*—Steven A. Bratlie

*Attorney, Agent, or Firm*—Mattern, Ware, Stoltz & Fressola

[57] ABSTRACT

A cosmetic powder brush dispenser for depositing cosmetic powder onto a brush within the unitary structure of the dispenser. The dispenser incorporates a deformable container for storing the cosmetic powder and a spray-head at the end of the container with an orifice and upstanding posts that ensure powder break-up prior to its exiting the orifice. A second embodiment of the device uses a metering collar to limit the amount of deformation of the container whereby a desired small quantity of cosmetic powder is forced therefrom.

7 Claims, 2 Drawing Sheets

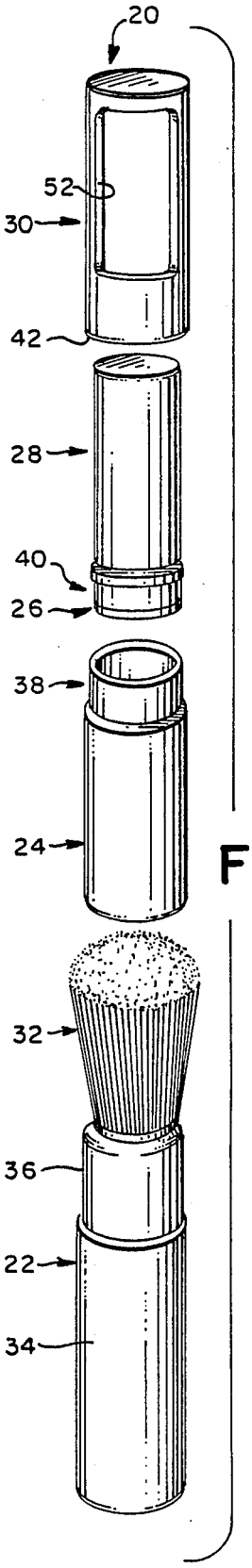
FIG. 1
FIG. 2
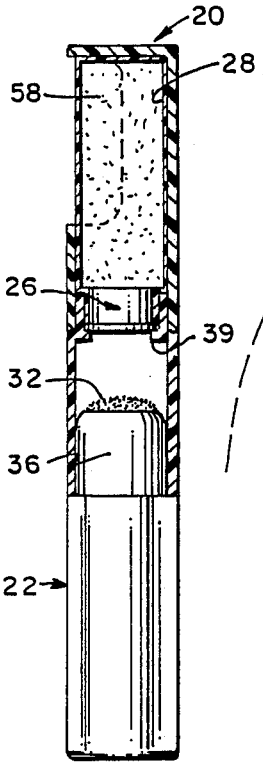
FIG. 3
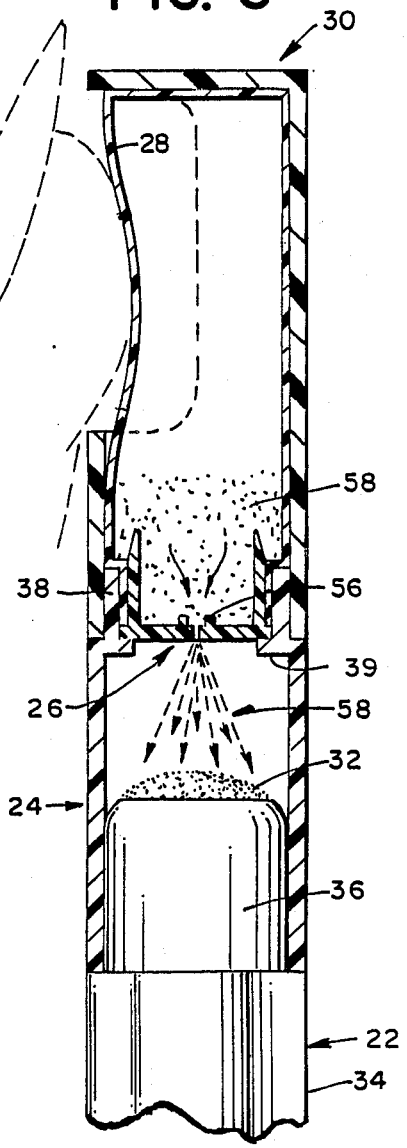
FIG. 5
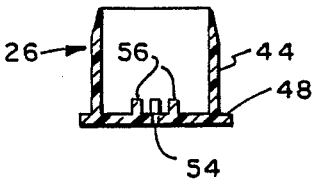
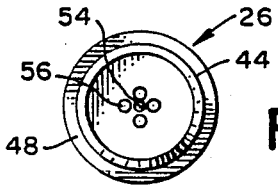
FIG. 4

FIG. 7
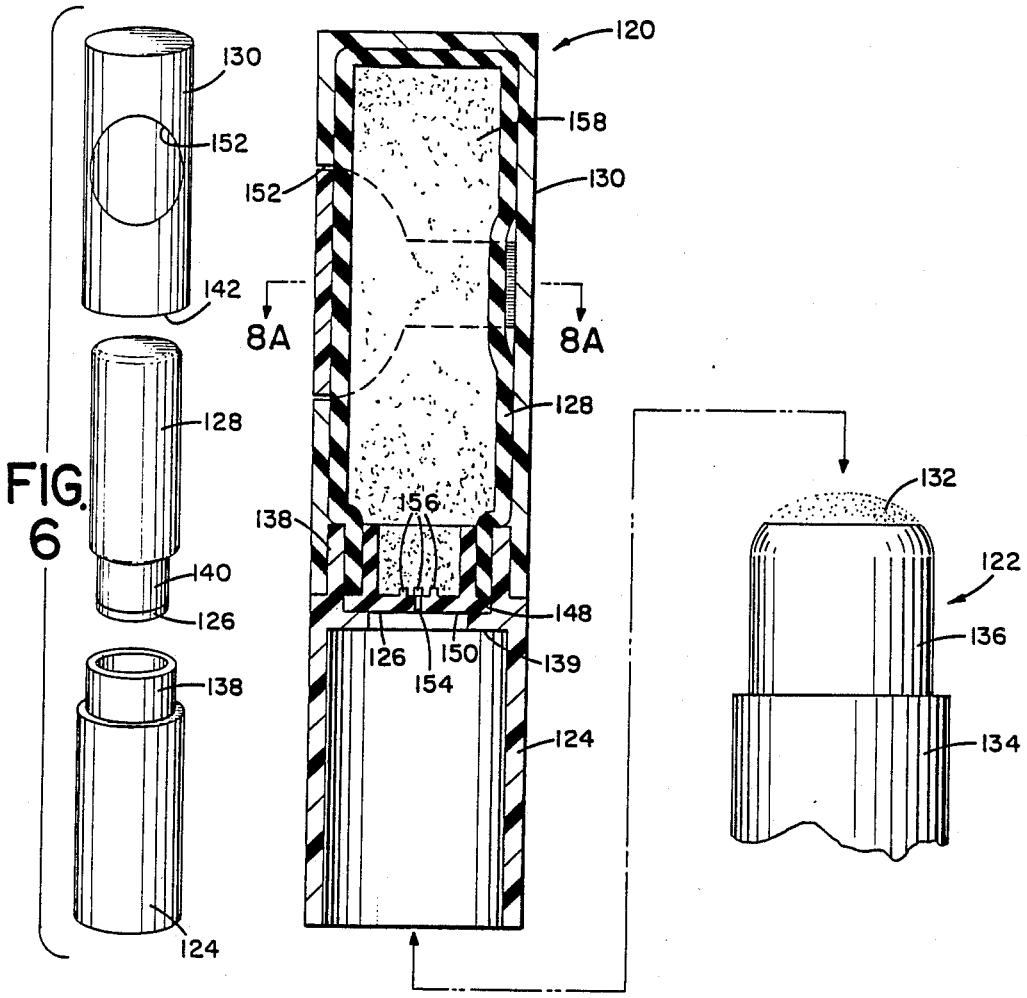
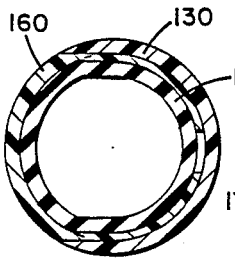
FIG. 8A
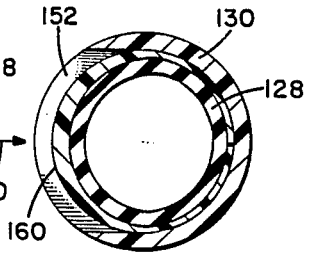
FIG. 8B
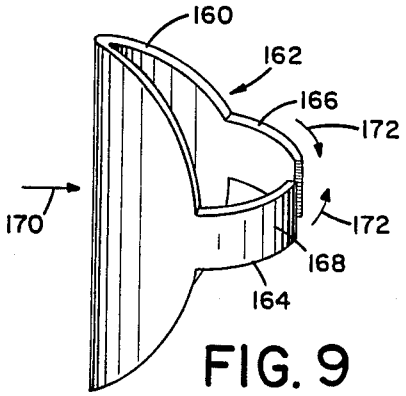
FIG. 9

COSMETIC POWDER BRUSH WITH METERED POWDER DISPENSER

CROSS REFERENCE TO RELATED APPLICATION

This is a continuation-in-part of application Ser. No. 07/144,555, filed Jan. 13, 1988 now abandoned.

TECHNICAL FIELD

The present invention relates to a cosmetic powder brush dispenser, and specifically to a device for the storage of cosmetic powder and its metered application to a brush within the dispenser for subsequent personal application.

BACKGROUND OF THE INVENTION

Since the advent of the popularity of rouge in the time of Louis XIV, to the present, there has been a problem with regard to storing and easily applying powdered cosmetic substances onto a person's face or other skin surface. Such cosmetic powders, including the popular "blushes" used today, typically have a sticky though powdery consistency, which presents a cleanliness problem when such substances inadvertently escape from their containers.

Attempts have been made to develop a dispenser for both storing the cosmetic powder as well for applying it to a cosmetic brush. However, due to the sticky, powdery nature of such powders, it has heretofore been difficult to apply a small carefully metered quantity of the powder onto a cosmetic brush in a finely distributed fashion while the brush is within the dispenser.

Prior art containers generally hold a small quantity of the cosmetic powder and includes a brush for the powder's personal application.

Thus, it has been found that if the blush material is stored in a deformable container having a plurality of holes at one end, squeezing such a container tends to either cause too much material to exit the container when the holes are relatively large, or, if the holes are relatively small, the sticky nature of the powder results in clogging of the holes, making the dispenser unusable.

The present invention overcomes these difficulties through use of a spray-head in combination with a deformable container that stores the cosmetic powder. The spray-head is located at one end of a deformable container forming part of an overall dispenser. The spray-head incorporates a plurality of upstanding posts, surrounding an orifice within the spray-head. The posts mechanically interact with the cosmetic powder prior to exiting through the central orifice so as to break up cosmetic powder and ensure that the particles exiting the orifice are relatively small, thereby eliminating any clogging of the orifice. To apply a metered quantity of powder to the brush, a metering collar surrounds the deformable container thereby permitting a limited amount of deformation of the deformable container.

Thus, the present cosmetic powder brush dispenser provides a storage environment for the cosmetic powder, as well as a means for applying the powder to a cosmetic brush within the dispenser for subsequent application to the user's skin.

SUMMARY OF THE INVENTION

A cosmetic powder brush dispenser according to the present invention incorporates a cosmetic brush, a cylinder member removably positioned on the end of the cosmetic brush holder so as to enclose the brush portion, a spray-head, a deformable container for storing the cosmetic powder, and a housing portion mountable to the other end of the cylinder member so as to partially enclose the deformable container while providing means for user deformation of the container. The means for deforming the container is a metering collar split at one side thereof and limiting the amount of deformation of the deformable container so as to provide a metered quantity of powder on the brush. The spray-head covers the open end of the deformable container and includes a central orifice and a plurality of upstanding posts extending inwardly toward the interior of the deformable container. The spray-head, through combination of the upstanding posts and central orifice, provides a mechanism for ensuring sufficient agitation and breakup of the cosmetic powder when the container is deformed so that the powder exiting the orifice is in a finely powdered state, thereby preventing central orifice clogging. This agitation also tends to diverge the exiting powder in a uniform fashion so as to be evenly distributed on the brush positioned below the orifice.

The user after squeezing the deformable container and thereby applying a small metered quantity of the cosmetic powder onto the end of the cosmetic brush, can remove the brush from the dispenser and apply the cosmetic powder. Upon completion, the cosmetic brush is reinserted into the cylinder member for storage until the next application.

OBJECTS OF THE INVENTION

It is therefore a principal object of the present invention to provide a cosmetic powder brush dispenser for storing a cosmetic brush and cosmetic powder in a single overall device and further, to provide a means for applying a small metered quantity of the cosmetic powder onto the end of the cosmetic brush prior to removal of the brush from the dispenser.

Another object of the present invention is to provide a cosmetic powder brush dispenser that incorporates a deformable container with an open end onto which is mounted a spray-head having a central orifice and a plurality of upstanding posts extending inwardly toward the deformable container so that the central orifice and posts provide agitation and breakup to the cosmetic powder when the container is deformed so as to ensure an even distribution of the exiting cosmetic powder as well as to prevent the cosmetic powder from clogging the orifice.

A further object to the present invention is to provide a cosmetic brush dispenser as described above, further incorporating a cylinder member which is interposed between the cosmetic brush holder and the deformable container and spray-head combination so as to position the cosmetic brush in axial alignment with the spray-head central orifice while preventing exiting cosmetic powder from escaping beyond the dispenser.

A still further object of the present invention is to provide a cosmetic powder brush dispenser as described above, further incorporating a cylindrically shaped housing member for overlying the deformable container, the housing member having a cutout portion with a metering collar therein to allow user to deform the deformable container in a limited manner to expend a small metered quantity of powder onto the brush.

Other objects of the present invention will in part be obvious and will in part appear hereinafter.

BRIEF DESCRIPTION OF THE DRAWINGS

For a fuller understanding of the nature and object of the present invention, reference should be made to the following detailed description taken in connection with the accompanying drawings, in which:

FIG. 1 is an exploded perspective view of the first embodiment of the cosmetic powder brush dispenser according to the present invention, showing the interrelationship of its constituent elements.

FIG. 2 is a partially cut-away elevational view of the first embodiment of the cosmetic powder brush shown in FIG. 1, illustrating the storage of cosmetic powder within a deformable container.

FIG. 3 is an elevational view of the first embodiment of the cosmetic powder brush dispenser, illustrating deformation of the deformable container so as to cause a quantity of the cosmetic powder within the deformable container to exit through the spray-head onto the associated cosmetic brush.

FIG. 4 is a top plan view of the spray-head, illustrating the posts and central orifice through which the cosmetic powder passes when the deformable container is squeezed by the user.

FIG. 5 is a side cross-sectional view of the spray-head shown in FIG. 4, illustrating details of the upstanding posts and central orifice.

FIG. 6 is an exploded perspective view of the second embodiment of the cosmetic powder dispenser having a metering collar for dispensing small metered quantities of cosmetic powder from the deformable container.

FIG. 7 is an exploded side elevational view of the second embodiment of the cosmetic powder brush with portions of the cosmetic powder dispenser cut-away to show internal structure.

FIG. 8A is a cross-sectional view taken along the 8A—8A line of FIG. 7 and showing the metering collar in its relaxed position.

FIG. 8B is a view similar to FIG. 8A but showing the metering collar in its fully engaged position.

FIG. 9 is a perspective view of the metering collar from the second embodiment of the present invention.

DESCRIPTION OF THE PREFERRED EMBODIMENTS

As best seen in FIG. 1, the first embodiment of a cosmetic powder brush dispenser 20 of the present invention comprises five primary constituent elements; namely, a cosmetic brush 22, an interfitting cylinder member 24, a spray-head 26, a deformable, resilient, container 28 into which is stored the cosmetic powder 58, and an outer housing member 30 enclosing the deformable container 28 over a substantial portion of its exterior surface. The cosmetic brush can be any readily available commercial cosmetic brush such as those commonly used in the application of lipstick, lip gloss and the like. Such cosmetic brushes typically include a brush 32 which is extendible by means of turning outer shaft portion 34 with respect to collar portion 36. The brush is normally stored in its retracted position such as shown in FIGS. 2 and 3.

As seen in FIGS. 1 and 2, the cylinder member 24 is dimensioned to frictionally overfit the collar 36 of cosmetic brush 22 so as to surround brush 32. As best seen in FIGS. 1 and 2, the cylinder member 24 has a stepped-down portion 38 with an inside terminating flange 39 dimensioned for receipt of spray-head disk 50 and the terminating open-end 40 of deformable container 28.

The outer wall of step-down portion 38 is dimensioned for receipt of the inner terminating wall 42 of housing member 30, again as best seen in FIGS. 1 and 2. As best seen in FIGS. 4 and 5, the spray-head 26 comprises a cylindrical wall portion 44 having an outer diameter dimensioned for frictionally interfitting with the interior wall 46. An outer lip or flange 48 forming part of the terminating disk 50 abuts the terminating open-end 40 of deformable container 28, so as to position the spray-head about the terminating end 40 of deformable container 28.

As seen in FIG. 2, the cosmetic powder brush dispenser 20 when in its assembled configuration totally encloses brush 32 of cosmetic brush 22 while keeping the brush in axial alignment with deformable container 28.

The deformable container 28 stores the cosmetic powder in a substantially sealed environment as seen in FIG. 2. As seen in FIGS. 1 and 2, the housing member 30 includes a cutout portion 52 which allows for manual depression of the deformable container as illustrated in FIG. 3.

The spray-head 26 preferably incorporates a centrally located orifice 54 and a plurality of upstanding posts 56 for facilitating application of the cosmetic powder 58 onto brush 32. It has been widely known that cosmetic powders, including the popular blush powders, have a tendency to form clump-like particles due to the inherent stickiness or oiliness of the powder. As a result, applicators having orifices tend to clog as a result of these particle agglomerates. If the orifices are made sufficiently large to allow such particle agglomerates to pass therethrough unimpeded, inadequate control of the cosmetic powder application results.

The present invention is able to use a small diameter orifice while preventing its occlusion through the interaction of upstanding posts 56 surrounding orifice 54. The posts tend to break up any particle agglomerates as they move toward exit orifice 54, thereby breaking such particle agglomerates into relatively small particles which can readily pass through orifice 54 without clogging the orifice. The small orifice diameter also ensures that a relatively small quantity of cosmetic powder is deposited onto brush 32 in a fairly even distribution. Such distribution is particularly suitable for user application.

It has been experimentally found that posts having a height of approximately 0.060 inch (1.5 mm) spaced about a central orifice having a diameter of 0.014 inch (0.36 mm) at a distance from adjacent post to adjacent post of approximately 0.03 inch (0.76 mm) achieves a relatively even distribution of the cosmetic powder 58 on brush 32 per depression of the deformable container 28 without clogging orifice 54. As also shown in FIG. 4, there are preferably four posts 56 surrounding central orifice 54, although this number need not be four.

The deformable container 28 is preferably formed from a clear or translucent deformable and resilient plastic so as to be readily deformable by finger pressure as shown in FIG. 3 while also allowing the user to readily discern the color of the cosmetic powder by observing the powder through cutout region 52 in housing member 30. Due to the container's resilient nature, it returns to its undeformed state after manual deformation.

The resulting cosmetic powder brush dispenser provides a means for storing cosmetic powder, such as blushes, in a container which permits easy identification of the cosmetic powder while also providing means for applying a quantity of the powder onto a cosmetic brush for application to the user's skin. The actual application of the powder to the brush is performed with the dispenser in its assembled configuration and the application of the cosmetic powder to the user's skin by cosmetic brush 22 is performed by removal of the brush from cylinder member 24.

Therefore the first embodiment of the present invention not only provides means for storing, viewing and applying a cosmetic powder onto a cosmetic powder brush, but also facilitates the actual use of the brush and stores the brush in an efficient and clean manner. The problems associated with other cosmetic brush storage devices including the spilling of the cosmetic powder, is thereby greatly reduced.

In FIGS. 6–9, there is illustrated a modified embodiment of the cosmetic powder brush dispenser of the present invention. Like components from the first embodiment are designated with similar numerals in this second modified embodiment but increased by a factor of 100.

The cosmetic powder brush dispenser 120 includes a cosmetic brush combination 122 having a retractable brush portion 132 (shown in its retracted position in FIG. 7) mounted in outer shaft and collar portions 134 and 136. An interfitting cylinder member 124 frictionally overfits collar 136 to hold it in assembly with the cosmetic brush combination 122. The upper end of the interfitting cylinder member 124 has a stepped down portion 138 and an inside terminating flange 139 for positioning with a spray head 126, a deformable, resilient container 128 and an outer housing member 130 so as to form an assembly. The spray head 126 has an exit orifice 154 providing a point of egress for cosmetic powder 158 from deformable container 128 and has four upstanding posts 156 surrounding orifice 154 to break up any particle agglomerates as they move toward orifice 154 just as found in the first embodiment.

In a manner similar to the first embodiment, the outer wall of step-down portion 138 is dimensioned for receipt of the inner terminating wall 142 of housing member 130. The spray-head 126 has an outer diameter dimensioned for frictionally interfitting with the interior of the deformable container 128. An outer lip or flange 148 forming part of the terminating disk 150 abuts the terminating open-end 140 of deformable container 128 so as to position the spray-head 126 about the terminating end 140 of deformable container 128.

The deformable container 128 stores the cosmetic powder 158 in a substantially sealed environment as seen in FIG. 7. As seen in FIGS. 6, 7, 8A and 8B, the housing member 130 includes a cutout portion 152 dimensionally sized to accept a finger engagement portion 160 of a metering collar generally indicated by numeral 162 which allows for manual depression of the deformable container as illustrated in FIG. 8B. The metering collar has an annular shaped body portion 164 having two opposing arms 166 and 168 extending into housing member 130 and surrounding the deformable container 128.

The second embodiment of the invention operates and is used in a manner similar to the first embodiment. However, as shown in FIGS. 8A and 8B, the metering collar 162 permits only a limited amount of squeezing pressure to be placed on the deformable container 128 thus forcing a small quantity of cosmetic powder 158 therefrom. In operation, the user puts finger pressure, designated by arrow 170, on the finger engagement portion 160 of metering collar 162 causing relative movement between the collar 162 and the housing member 130. This relative movement causes the gap between the arms 166 and 168 to close as designated by arrows 172 placing the desired amount of squeezing pressure on the deformable container 128. The amount of squeezing pressure can be accurately chosen when the collar 162 is manufactured by altering the length and width of arms 166 and 168. The collar 162 will return to its relaxed position shown in FIG. 8A when the finger pressure 170 is released due to the natural resiliency and memory of the plastic resin material from which it is manufactured.

Thus, it can be seen from the foregoing specification and the attached drawings that the cosmetic powder brush with metered powder dispenser provides an effective means for depositing a desired quantity of powder on the associated brush.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the cosmetic powder brush dispenser described herein, and all statements of the scope of this invention which, as a matter of language, might be said to fall therebetween.

Having described the invention, what is claimed is:

1. A cosmetic powder dispenser comprising:

A. cosmetic powder receiving and application means;

B. a manually deformable resilient container for the storage of cosmetic powder prior to its application onto the cosmetic powder receiving and application means;

C. a spray-head interfitted to the deformable container, the spray-head including at least one orifice through which the cosmetic powder passes to exit from the container;

D. means for deforming the container in a limited manner so that a finite quantity of the cosmetic powder is forced out of the container through the orifice onto the cosmetic powder receiving and application means when the deformable container is deformed, comprising a metering collar at least partially surrounding the container, including a finger engagement portion with a pair of arcuate arm portions extending therefrom around the deformable container, and having ends normally spaced apart in juxtaposed relation; and E. a housing member dimensioned for surrounding the deformable container and having a cutout portion within which the finger engagement portion of the metering collar is positioned so as to facilitate user deformation of the container;

F. with the pair of arm portions being interposed between the container and the housing member whereby a suitable force on the finger engagement portion of the metering collar causes relative movement between the collar and the housing to place a squeezing pressure on the deformable container thereby forcing cosmetic powder through the orifice;

G. wherein the squeezing pressure on the deformable container is limited by abutment of the juxtaposed ends of the arcuate arm portions of said metering collar with each other, thereby limiting the finite quantity of powder dispensed upon each user deformation of the container.

2. A cosmetic powder dispenser as defined in claim 1, wherein the cosmetic powder receiving and application means is a cosmetic brush having an extensible brush portion.

3. A cosmetic powder dispenser as defined in claim 2, wherein the spray-head comprises a central orifice and at least two posts positioned about the central orifice.

4. A cosmetic powder dispenser as defined in claim 1, further comprising means for positioning the cosmetic powder receiving and application means in juxtaposed spaced relationship to the spray-head.

5. A cosmetic powder brush dispenser comprising:

(A) a cosmetic brush;

(B) a manually deformable resilient container for the storage of cosmetic powder prior to its application onto the cosmetic brush;

(C) a spray-head interfitted to the deformable container, the spray-head including at least one orifice through which the cosmetic powder passes to exit from the container;

(D) means for removably positioning the cosmetic brush in juxtaposed spaced relationship to the spray-head orifice so as to facilitate cosmetic powder application to the cosmetic brush when the deformable container is deformed;

(E) means for deforming the container in a limited manner so that a finite quantity of the cosmetic powder is forced out of the container through the orifice onto the cosmetic brush when the deformable container is deformed, comprising a metering collar at least partially surrounding the container, including a finger engagement portion with a pair of arcuate arm portion extending therefrom around the deformable container, and having ends normally spaced apart in juxtaposed relation; and (F) a housing member dimensioned for surrounding the deformable container and having a cutout portion within which the finger engagement portion of the metering collar is positioned so as to facilitate user deformation of the container;

(G) with the pair of arm portions being interposed between the container and the housing member whereby a suitable force on the finger engagement portion of the metering collar causes relative movement between the collar and the housing to place a squeezing pressure on the container thereby forcing cosmetic powder through the orifice;

(H) wherein the squeezing pressure on the deformable container is limited by abutment of the juxtaposed ends of the arcuate arm portions of said metering collar with each other, thereby limiting the finite quantity of powder dispensed upon each user deformation of the container.

6. The cosmetic powder brush dispenser defined in claim 5, wherein the cosmetic brush has an extensible brush portion.

7. A cosmetic powder brush dispenser as defined in claim 6, wherein the spray-head comprises a central orifice and at least two posts positioned about the central orifice.

* * * * *